US010060624B2

(12) United States Patent
Miles et al.

(10) Patent No.: US 10,060,624 B2
(45) Date of Patent: Aug. 28, 2018

(54) DAMPER FOR DIRECT VENT FIREPLACE INSERT

(75) Inventors: Martin Miles, West Vancouver (CA); Byron Book, North Vancouver (CA)

(73) Assignee: Miles Industries Ltd., North Vancouver (CA)

( * ) Notice: Subject to any disclaimer, the term of this patent is extended or adjusted under 35 U.S.C. 154(b) by 951 days.

(21) Appl. No.: 12/906,757

(22) Filed: Oct. 18, 2010

(65) Prior Publication Data

US 2012/0090596 A1 Apr. 19, 2012

(51) Int. Cl.

| | |
|---|---|
| ***F23L 13/00*** | (2006.01) |
| ***F23N 3/04*** | (2006.01) |
| ***F24B 1/189*** | (2006.01) |
| ***F24C 3/00*** | (2006.01) |
| ***F24C 15/00*** | (2006.01) |

(52) U.S. Cl.

CPC ..... *F23L 13/00* (2013.01); *F23N 3/04* (2013.01); *F24B 1/1895* (2013.01); *F24C 3/006* (2013.01); *F24C 15/002* (2013.01); *F23J 2211/10* (2013.01)

(58) Field of Classification Search

USPC ..... 126/502, 536; 49/2

See application file for complete search history.

(56) References Cited

U.S. PATENT DOCUMENTS 1,012,266 A * 12/1911 Miller ..... F23L 13/02 126/292
3,096,754 A * 7/1963 Solomon ..... F24B 1/1802 126/503
3,168,088 A * 2/1965 Martin et al. ..... 126/77
3,681,729 A * 8/1972 Elders ..... G05B 19/02 200/38 R
3,834,076 A * 9/1974 Vallee et al. ..... 49/2
4,114,805 A * 9/1978 Humphreys ..... F23L 11/005 126/285 R
4,163,440 A * 8/1979 Stultz ..... 126/60
4,179,065 A * 12/1979 Zung ..... 126/521
4,184,473 A * 1/1980 McIntire et al. ..... 126/502
4,235,219 A * 11/1980 DeFoe ..... F24B 1/1895 126/504
4,245,778 A * 1/1981 Diermayer ..... 236/1 G
4,262,608 A * 4/1981 Jackson ..... F23J 13/025 110/162
4,267,818 A * 5/1981 Taylor ..... 126/518
4,270,513 A * 6/1981 Mitchelson ..... 126/502
4,691,686 A * 9/1987 Alvarez ..... 126/77
4,793,322 A * 12/1988 Shimek et al. ..... 126/80
5,092,313 A * 3/1992 Blackburn et al. ..... 126/512

(Continued)

FOREIGN PATENT DOCUMENTS

EP 0268407 5/1988

*Primary Examiner* — Vivek Shirsat
(74) *Attorney, Agent, or Firm* — Smiths IP; Paul Smith

(57) ABSTRACT

A damper mechanism restricting combustion and exhaust air flow in response to temperature changes in a direct vent sealed combustion gas fireplace is provided. The mechanism allows the fireplace to have unrestricted air flow when the fireplace is not on and to restrict the air flow when the fireplace is on. A bi-metallic temperature responsive element is used to move a restrictor element to restrict air flow allowing maximum air displacement during cold ignition and enhancing operating efficiency when the fireplace is on.

9 Claims, 7 Drawing Sheets

(56) References Cited

U.S. PATENT DOCUMENTS 5,218,953 A * 6/1993 Shimek ..... F24C 15/002 126/512
5,263,471 A * 11/1993 Shimek ..... F23G 7/06 126/193
5,267,552 A 12/1993 Squires et al.
5,320,086 A * 6/1994 Beal ..... F23J 13/025 126/512
5,452,708 A * 9/1995 Shimek ..... F24B 1/1808 126/512
5,503,550 A * 4/1996 DePalma ..... 431/125
5,575,274 A * 11/1996 DePalma ..... F23D 14/72 126/285 R
5,669,374 A * 9/1997 Valters et al. ..... 126/512
5,746,588 A * 5/1998 Binzer ..... 431/354
5,839,458 A * 11/1998 Delcarson ..... 134/113
5,915,375 A * 6/1999 Reyher ..... F24B 1/1808 126/512
5,947,113 A * 9/1999 Beal et al. ..... 126/512
5,967,139 A * 10/1999 Hussong ..... F24B 1/1895 126/285 A
6,003,507 A * 12/1999 Flick et al. ..... 126/515
6,227,194 B1 * 5/2001 Barudi ..... F24B 1/1808 126/112
6,463,926 B1 * 10/2002 Flick et al. ..... 126/512
7,066,170 B1 * 6/2006 Atemboski ..... F24B 1/1808 126/502
7,451,759 B2 11/2008 Weiss et al.
7,726,300 B2 * 6/2010 Lyons ..... F24B 1/1808 126/500

* cited by examiner

DAMPER FOR DIRECT VENT FIREPLACE INSERT

FIELD OF THE INVENTION

This invention relates to direct vent, sealed combustion gas fireplaces. In particular, this invention is directed to a method and apparatus for controlling the air flow to enhance the operating efficiency of a direct vent, sealed combustion gas fireplace while accommodating the need for a relatively unrestricted air supply during ignition in a fireplace.

BACKGROUND OF THE INVENTION

Unlike open flue wood or gas fireplaces that draw combustion air from the room in which they are located, the fireboxes of direct vent gas fireplaces are sealed from the room air. The fireplaces draw combustion air into the firebox from outside the building through air intake ducts and exhaust the combustion gases from the firebox out of the building through exhaust ducts. Air flow through the firebox and the ducting systems during operation of direct vent gas fireplaces is typically driven by thermal convection and the buoyancy of the combustion products. Relatively cool combustion air is drawn in and down a vertically offset run of inlet duct while heated air rises along a vertically offset run of the exhaust duct. Ideally, the intake and exhaust ducts are entirely vertical, but they may vent horizontally from a wall of the building provided there is an adequate vertical run to ensure gravity-fed operation.

As discussed in U.S. Pat. No. 5,267,552 to Squires et. al, air flow through the firebox and the duct system may be enhanced by a blower. This can be particularly useful when the ducts are not sufficiently vertical to rely on convection and the buoyancy of the gas combustion products.

One problem in the management of air flow of direct vent gas fireplaces is to ensure that a sufficient amount of combustion air is available during ignition of the fireplace while avoiding inefficiencies due to the loss of heated combustion products during operation of the fireplace. Optimizing the efficient operation of the fireplace entails restricting the excess air flow through the firebox and to the combustion gas outlet while the fireplace is in operation. However, such restriction poses a corresponding problem during start-up when the air in the intake and exhaust vents is cool and stagnant. In order achieve effective ignition of the burners, the air flow must be as unrestricted as possible so as to enable it to immediately begin moving. The failure to do so may result in lift-off of the flame and the ignition of pockets of built up gas, or in starving the ignition system of combustion air and a failure to maintain ignition.

The optimal air flow required for successful ignition is therefore greater than the air flow desired for maximum efficiency during operation of the fireplace. This trade off is usually addressed by, at the time of installation, selecting a degree of restriction for the fireplace that achieves a measure of efficiency during fireplace operation but that also provides for sufficiently unrestricted movement of air during start up. The solution is nonetheless inefficient.

European Patent App. No. 0268407 to Shimek et al. discloses a direct vent gas fireplace in which a primary air supply is provided through a primary air duct. However, when the combustion chamber is cold, there is not a sufficient supply of hot exhaust gases to produce or induce a draw from the primary air duct. A secondary slot is therefore provided to allow entry of a supply of secondary air directly to the burner area to assist in igniting the burner under cold conditions. This secondary slot is closed off by a pivoting damper, actuated by a bi-metallic element, once the fireplace has heated up sufficiently. While this approach may assist in maintaining ignition, it still suffers the drawback of significant heat losses during continued operation of the fireplace because it is not intended to control overall air flow through the fireplace.

In sealed combustion gas fireplace systems, the problem of ignition air volume is sometimes addressed by maintaining a standing pilot flame that generates a small amount of air flow through the fire box and venting system. This is particularly so in colder climates. However in some jurisdictions, the use of a standing pilot flame is falling out of favour with regulatory authorities because of perceived energy conservation reasons. As the standing pilot has almost universally been used to ensure air flow through the firebox and duct system in colder climates, the absence of a standing pilot creates a challenge to reliable ignition of the burner.

U.S. Pat. No. 5,503,550 to DePalma discloses a gas fireplace system in which a manually operated pilot light unit replaces the standing pilot light. An automatic damper mechanism, including a rotatable damper vane and a controller actuated by a motor, controls air flow through the flue in the fireplace. The controller is hard-wired into the electric lines of the building in which it is installed, which may make the system difficult to install or retrofit. In an alternative embodiment, the damper vane includes thermally-activated bi-metallic quadrants. However, the quadrants are designed to keep the flue closed until the fireplace produces enough heat that the vanes to flex to an open flue position. This does not assist in ensuring that there is a sufficient air supply at ignition of the fireplace burners.

U.S. Pat. No. 7,451,759 to Weiss et al. discloses a wireless damper control device for a fireplace, eliminating the need to hard-wire a control system into the building. This damper control system will open the damper immediately upon request to ignite the gas fireplace. Once the damper indicates to the control system that it is open, gas is allowed to flow to the ignition system. This should allow enough air to flow to successfully ignite the fireplace, but the circuitry and signalling required in this system is relatively complex. Further, in this system, the damper remains open during the burner operation and is only intended to close the flue system in the off cycle.

It is therefore an object of the present invention to provide for the efficient control of air flow in a direct vent sealed combustion gas fireplace that does not have a standing pilot, that maximizes the operating efficiency, while enabling sufficient air flow during a cold start to maximize the chances of successful ignition without the need for complicated electronics or signalling mechanisms.

This and other objects of the invention will be better understood by reference to the detailed description of the preferred embodiment which follows. Note that not all of the objects are necessarily met by all embodiments of the invention described below or by the invention defined by each of the claims.

SUMMARY OF THE INVENTION

In one aspect, the invention comprises a method and apparatus to control the air flow into a direct vent sealed fireplace, in which the air flow through the firebox is minimized when the fireplace is cold, namely at initial ignition. The air flow is then restricted as the temperature increases. This arrangement provides sufficient air flow at ignition to prevent starvation of the ignition system, but minimizes the loss of heated air once the firebox is in full operation.

According to the invention, the air flow through the firebox is restricted as the temperature in the firebox or of the combustion gases increases. This may be accomplished automatically by means of a temperature sensitive deformable bi-metallic element. When the fireplace is cold, the air flow is unrestricted by the by-metallic element, allowing a relatively large volume of air from the air supply and venting system to quickly be displaced to support continued ignition, until the burner reaches normal operation, at which time operating efficiency is maintained by temperature sensitive restriction of the combustion air flow.

In the preferred embodiment, the air flow is restricted by means of a restrictor element that moves to at least partially obstruct an air flow passageway, preferably an air inlet into the firebox, the element being mechanically actuated by deformation of the bi-metallic element.

In one aspect, the invention comprises a direct vent gas fireplace having a sealed combustion system in which a combustion air supply and venting system is substantially sealed in relation to a room in which the gas fireplace is disposed, wherein the combustion air supply and venting system defines a passageway for combustion air and combustion products, and wherein the passageway is restricted in response to an increase in temperature. In a further aspect, the passageway may include a combustion air intake for drawing outside air into a firebox of the gas fireplace, and the combustion air intake may be restricted in response to an increase in temperature. In a further aspect, the passageway may include a combustion products exhaust for venting combustion products from a firebox of the gas fireplace to the outside, and the exhaust may be restricted in response to an increase in temperature. In yet a further aspect, the passageway may be restricted in response to an increase in temperature in a firebox of the gas fireplace, and/or in response to an increase in temperature in air flowing through the room. In yet a further aspect, the passageway may include a combustion products exhaust for venting combustion products from a firebox of the gas fireplace to the outside and the passageway is restricted in response to an increase in temperature in the exhaust.

In another aspect, the invention comprises a gas fireplace having a sealed combustion system in which a combustion air supply and venting system is substantially sealed in relation to a room in which the gas fireplace is disposed, the combustion air supply and venting system defining a passageway for combustion air and combustion products, and comprising a restrictor element operative to restrict the passageway in response to an increase in temperature. In a further aspect, the passageway may include a combustion air intake for drawing outside air into a firebox of the gas fireplace, and the restrictor element may be operative to restrict the combustion air intake. In yet a further aspect, the passageway may include a combustion products exhaust for venting combustion products from a firebox of the gas fireplace to the outside, and the restrictor element may be operative to restrict the exhaust. In a further aspect, the restrictor element may be operative to restrict the passageway in response to an increase in temperature in a firebox of the gas fireplace, and/or in response to an increase in temperature in air flowing through the room. In a further aspect, the passageway may include a combustion products exhaust for venting combustion products from a firebox of the gas fireplace to the outside, and restrictor element may be responsive to restrict the passageway in response to an increase in temperature in the exhaust.

In another aspect, the invention comprises a direct vent, sealed combustion gas fireplace comprising a firebox; an air intake for drawing combustion air into the firebox; an exhaust outlet for exhausting combustion products from the firebox; and a damper effective to restrict air flow through the firebox in response to an increase in temperature. The damper may comprise a bi-metallic element deformable under the influence of a change in temperature, and may further comprise a restrictor element actuated by deformation of the bi-metallic element. The damper may further comprise a shaft between the bi-metallic element and the restrictor element, the shaft actuating movement of the restrictor element along the shaft when the bi-metallic element deforms under the influence of a change in temperature. The bi-metallic element may comprise a pair of bi-metallic strips. In a further aspect, the bi-metallic element may be mounted in an enclosure on a wall of the firebox. In yet a further aspect, the restrictor element may be spring-biased toward a position wherein the restrictor element does not restrict the air flow when the firebox is cold. The restrictor element may be spring-biased against displacement in one direction. In yet a further aspect, the restrictor element may comprise at least one aperture.

In another aspect, the damper may operate in response to a change in temperature in the firebox, in the exhaust outlet, and/or in the air flowing from a room in which the fireplace is disposed.

In another aspect, the invention comprises a damper mechanism for a direct vent sealed combustion gas fireplace comprising a damper effective to restrict air flow through a firebox of the gas fireplace in response to an increase in temperature, comprising a bi-metallic element deformable under the influence of a change in temperature and a restrictor element actuated by deformation of the bi-metallic element. The restrictor element may be spring-biased against displacement in one direction. The bi-metallic element may comprise a pair of facing bi-metallic strips. The restrictor element may comprise a plurality of apertures. The damper may further comprise a shaft between the bi-metallic element and the restrictor element that actuates movement of the restrictor element along the shaft when the bi-metallic element deforms under the influence of a change in temperature.

In another aspect, the invention comprises a method of controlling combustion air flow in a direct vent, sealed combustion gas fireplace comprising the steps of providing a bi-metallic element positioned near an air passageway between the fireplace and a source of combustion air; restricting the air passageway by deformation of the bi-metallic element in response to an increase in temperature. In a further aspect, the deformation of the bi-metallic element may cause a restrictor element to move to restrict the air passageway. The bi-metallic element may be spring-biased away from the air passageway. In another aspect, the method may include the step of igniting a combustion gas source within a firebox in the fireplace to increase the temperature of the fireplace.

In another aspect, the invention comprises a damper mechanism for a direct vent sealed combustion gas fireplace, comprising a bi-metallic element responsive to temperature changes within the fireplace; and a biasing mechanism to bias the bi-metallic element away from an air passageway within the fireplace; wherein movement of the bi-metallic element in response to a temperature increase causes restriction of the air passageway by overcoming the bias. The biasing mechanism may comprise a spring. In a further aspect, movement of the bi-metallic element may actuate a restrictor element to move towards the air vent. The bi-metallic element may comprise a pair of bi-metallic strips. The restrictor element may further comprise a plurality of aperture.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
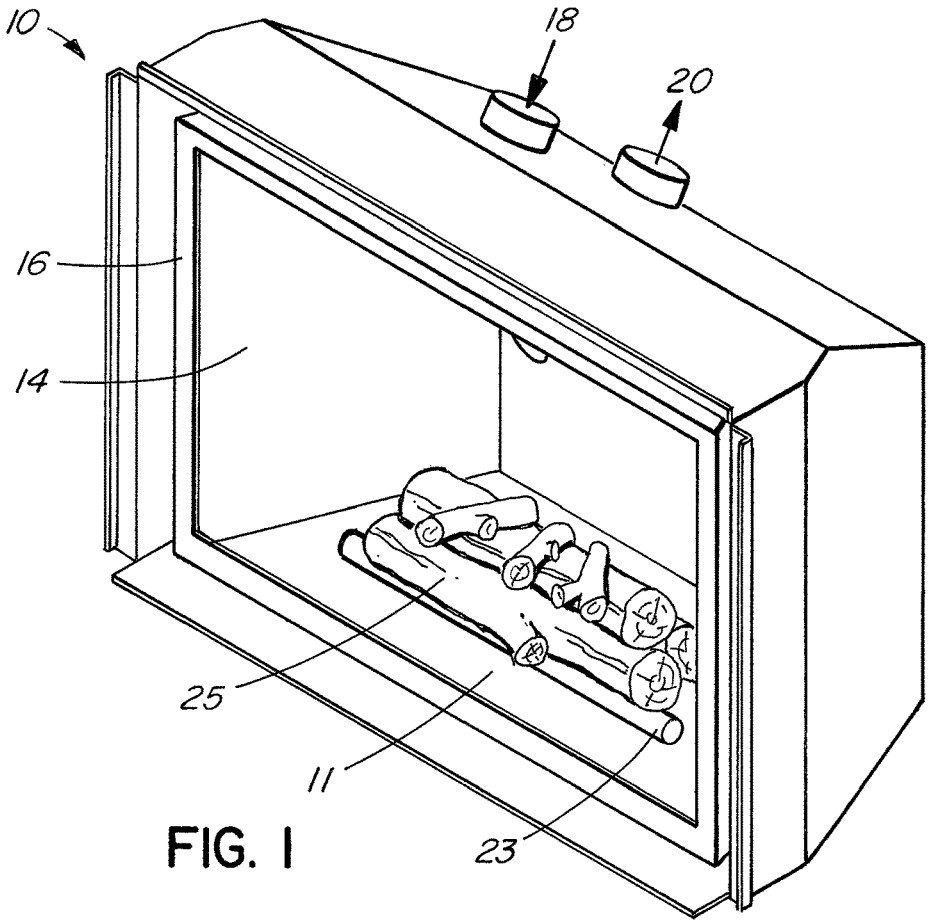
FIG. 1 is a perspective view of an insert for a sealed combustion gas fireplace including the damper mechanism of the invention in accordance with the preferred embodiment.
Figure 2:
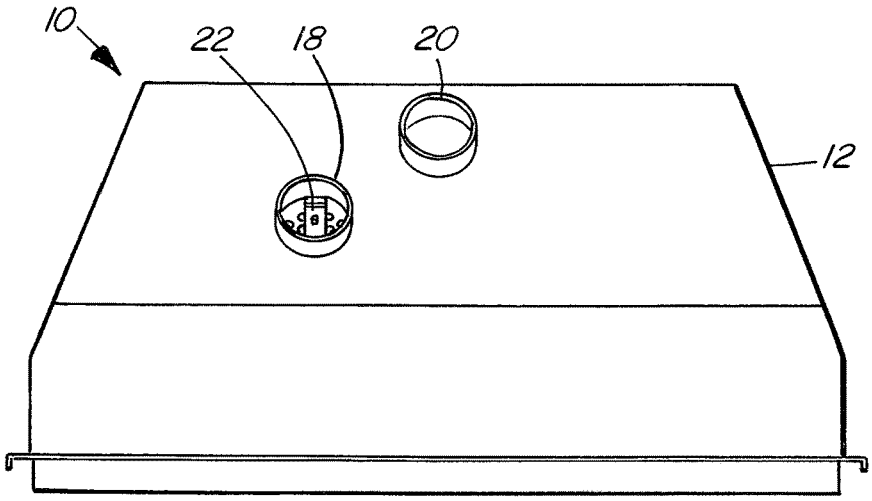
FIG. 2 is a top view of the insert of FIG. 1.
Figure 3:
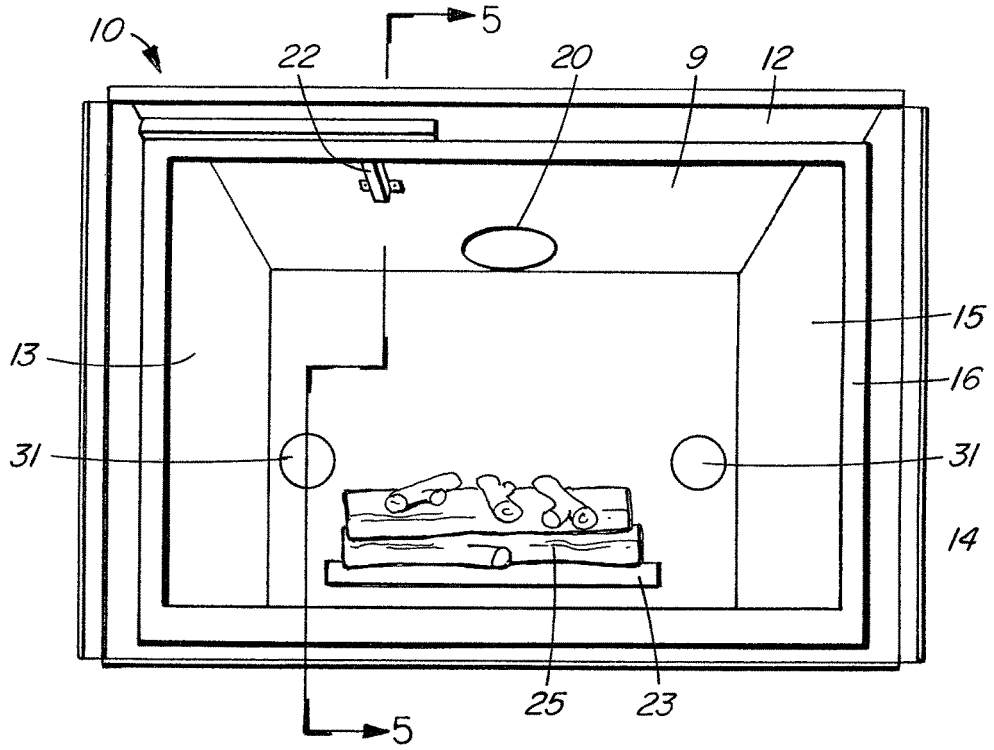
FIG. 3 is a front view of the insert of FIG. 1.

Referring to FIGS. 1-3, a sealed direct vent gas fireplace 10 includes an outer shroud 12 surrounding a firebox 14. A glass panel 16 seals the firebox 14 from the air inside the room in which the fireplace is located. Fireplace 10 also includes burner 23 and logset 25 within the firebox. It will be understood that certain elements such as false walls, baffles and various cosmetic elements are omitted from the drawings for clarity, but may or may not be included in a fireplace 10 comprising the invention described herein.

Figure 9:
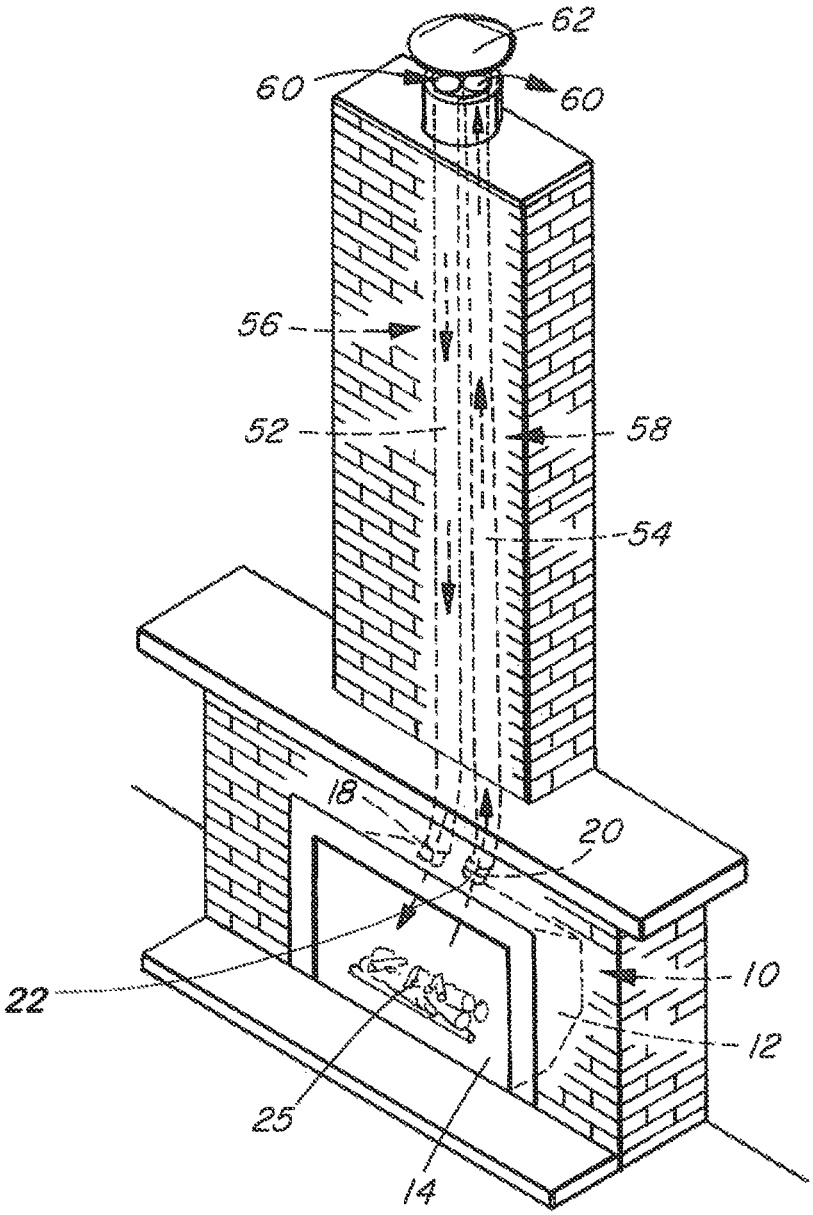
FIG. 9 is a schematic view of the insert and ducting in place within a fireplace.

Combustion air is supplied to the fireplace by means of an air inlet 18 and gas combustion products are vented through exhaust outlet 20. As best seen in FIG. 9, during installation of the fireplace in a building, air inlet 18 is connected to an intake duct 52 to allow combustion air from outside the building to be drawn into the fireplace and the firebox 14. Similarly, exhaust outlet 20 is connected to an exhaust duct 54 for exhausting gas combustion products out of the building. The combination of the air inlet 18 and intake duct 52 define a combustion air intake system 56 while the combination of the exhaust outlet 20 and the exhaust duct 54 define a combustion products exhaust system 58. The combustion air intake system 56 and combustion products exhaust system 58 form an air supply and venting system denoted by arrows 60, through which combustion air is drawn from outside the building into the firebox 14 through the combustion air intake 56, and gas combustion products are vented to the outside through the combustion products exhaust 58.

The air supply and venting system 60 is substantially sealed relative to the room in which the fireplace is located such that air flows only in from outside the building, through the firebox 14 and back outside though a vent terminal 62. When the fireplace is off, the air pressure inside the firebox 14 should equal the outside atmospheric pressure in the vicinity of the vent terminal 62.

Referring again to FIGS. 1-3, a damper mechanism 22 is provided in the air supply and venting system 60 to restrict the system 60 when the temperature increases as a result of operation of the burner 23. As a result, prior to ignition when the fireplace is cold and the air in the air supply and venting system 60 is stagnant, the system 60 is as unrestricted as possible, allowing a substantial volume of air to quickly be displaced to support ignition and minimize burner flame lift-off. Once the fireplace is in normal operation, the damper will operate to restrict the system 60 and promote more efficient burning by reducing heat losses to the outside. It will be appreciated that restriction along any portion of the system 60 will be effective to reduce the flow of air and combustion gases therethrough. As a result, the restriction may be applied with equal results along the combustion air intake system 56 or the combustion products exhaust system 58. According to the preferred embodiment, the restriction provided by the damper is applied to the combustion air intake system 56 and in particular to the air inlet 18. This is preferred over providing the damper 22 in the combustion products exhaust system 58 due to the relatively lower temperatures in the vicinity of the incoming combustion air, allowing the use of less temperature tolerant materials for the damper 22 while still being responsive to changes in temperature.

Figure 4:
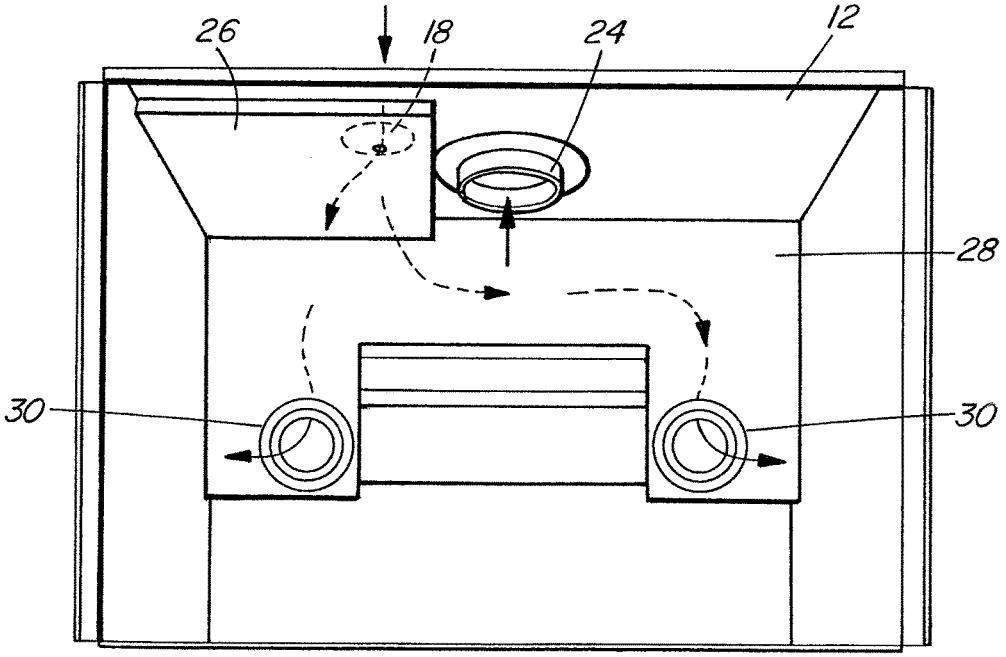
FIG. 4 is a front view of the shroud of the insert of FIG. 1, with the walls defining the firebox having been removed.

In FIG. 4, the firebox walls 9, 11, 13 and 15 that are visible in FIGS. 1 and 3 have been removed to more clearly reveal the structure of shroud 12. A collar 24 is mounted to exhaust outlet 20 to direct exhaust gases from the firebox 14 through the shroud 24. Baffle 26 and rear false wall 28 direct incoming combustion air from air inlet 18 to openings 30 in the vicinity of the burner 23 (not shown). The combustion air then passes through corresponding openings 31 (seen in FIG. 3) at the rear of the firebox 14. Heated air, now comprising combustion products from combustion of the gas in the fireplace, will eventually pass through exhaust outlet 20 into the exhaust duct 54 (not shown) and to the outdoors.

Figure 5:
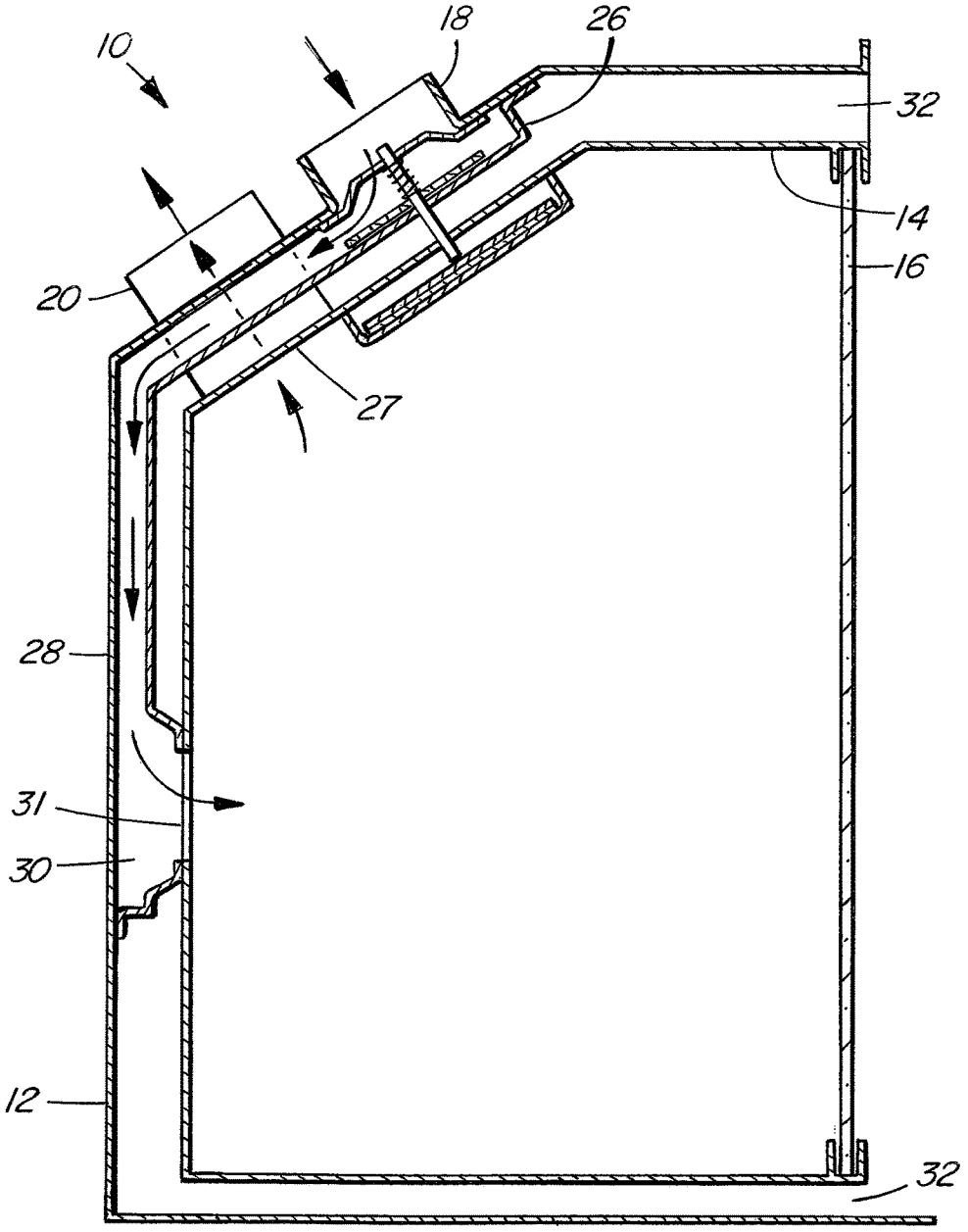
FIG. 5 is a sectional view of the insert of FIG. 3, taken along line A-A of FIG. 3.

The flow of air and gasses is also shown in FIG. 5, including the flow from the air inlet 18, past damper mechanism 22, along rear wall 28 of shroud 12, and into the firebox 14 through rear intake vents 30. FIG. 5 also shows the convection passageway 32 through which room air may enter the insert 10, pass around firebox 14, and re-enter the room heated by contact with the outside of firebox 14, as is typical of sealed fireplace inserts. Convection passageway 32 is entirely separate and not in communication with the passageway that comprises the combustion air and combustion products venting system 60 (not shown).

Figure 6:
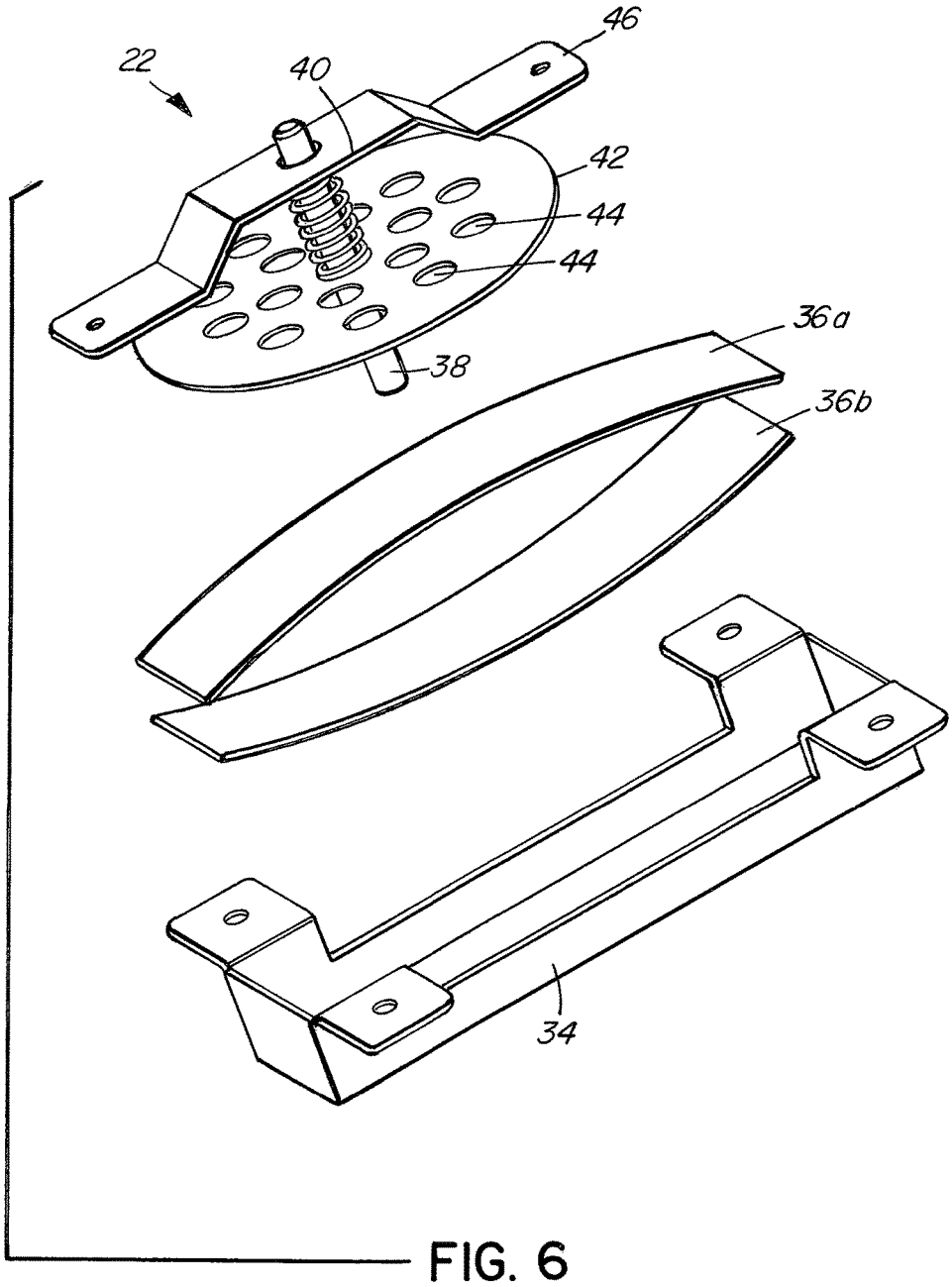
FIG. 6 is an exploded perspective view of the elements of the damper mechanism.

The components of the damper mechanism 22 of the preferred embodiment are shown in FIGS. 5 and 6. Retainer 34 is attached to an inside wall segment 27 of the firebox 14 in the general vicinity of the air inlet 18. Retainer 34 is preferably in the form of an enclosure suitable for housing a bi-metallic element 36, and to constrain the direction of deformation of the bi-metallic element as it reacts to the the influence of changes of temperature in the firebox 14. The bi-metallic element 36 is shown in FIG. 6 as a pair of elongated bi-metallic strips 36*a*, 36*b* arranged to deform in opposite directions. Any appropriate size and shape of bi-metallic material may be used, but according to the preferred embodiment the bi-metallic strips 36*a*, 36*b* are configured and constrained to displace a shaft 38 that is secured through wall segment 27.

The top surface of the uppermost bi-metallic strip 36*a* is in contact with shaft 38. A spring 40 is provided on shaft 38 and rests against a disk-shaped restrictor plate 42 through which shaft 38 extends. Bracket 46 is mounted across the air inlet 18 to retain the free end of shaft 38.

Restrictor plate 42 corresponds in diameter to the air inlet 18. Spring 40 biases restrictor plate 42 towards the bi-metallic strips 36, such that movement of bi-metallic strips 36 must overcome the spring force of spring 40 to move restrictor plate 42 which is therefore in a normally open state in relation to air inlet 18.

Restrictor plate 42 may be provided with one or more apertures 44, in order to allow some air flow into the fireplace insert, even when the damper mechanism 22 is in a closed position. The number and size of apertures 44 may be selected based on the minimum amount of air flow necessary for efficient operation of the fireplace.

Figure 7:
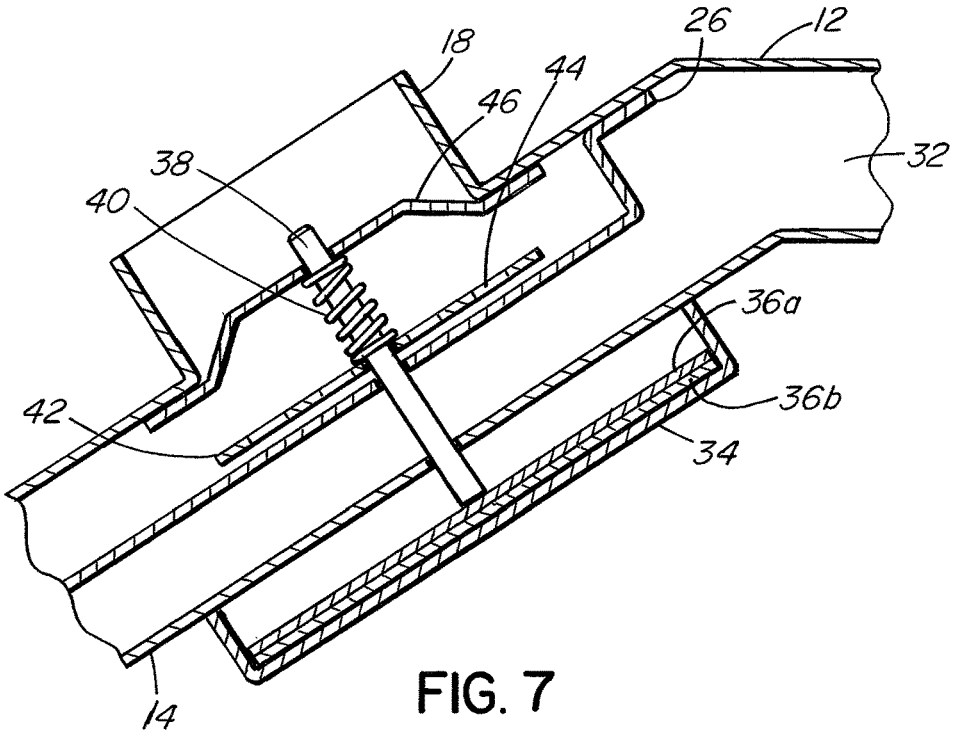
FIG. 7 is an enlarged sectional view of the damper mechanism of the invention, in which the damper is open.
Figure 8:
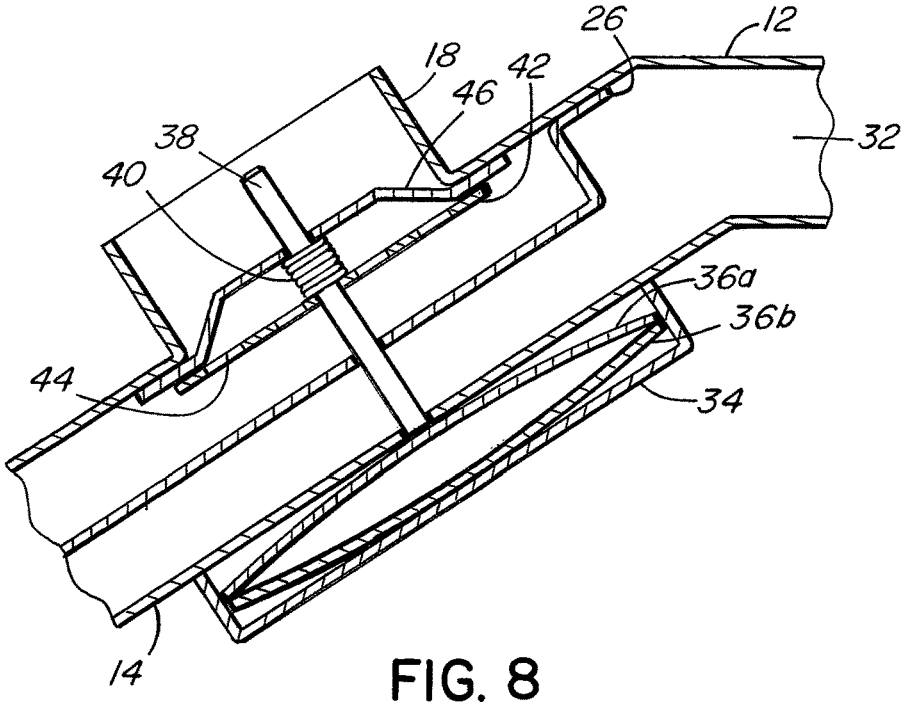
FIG. 8 is an enlarged sectional view of the damper mechanism of the invention, in which the damper is closed.
Figure 10:
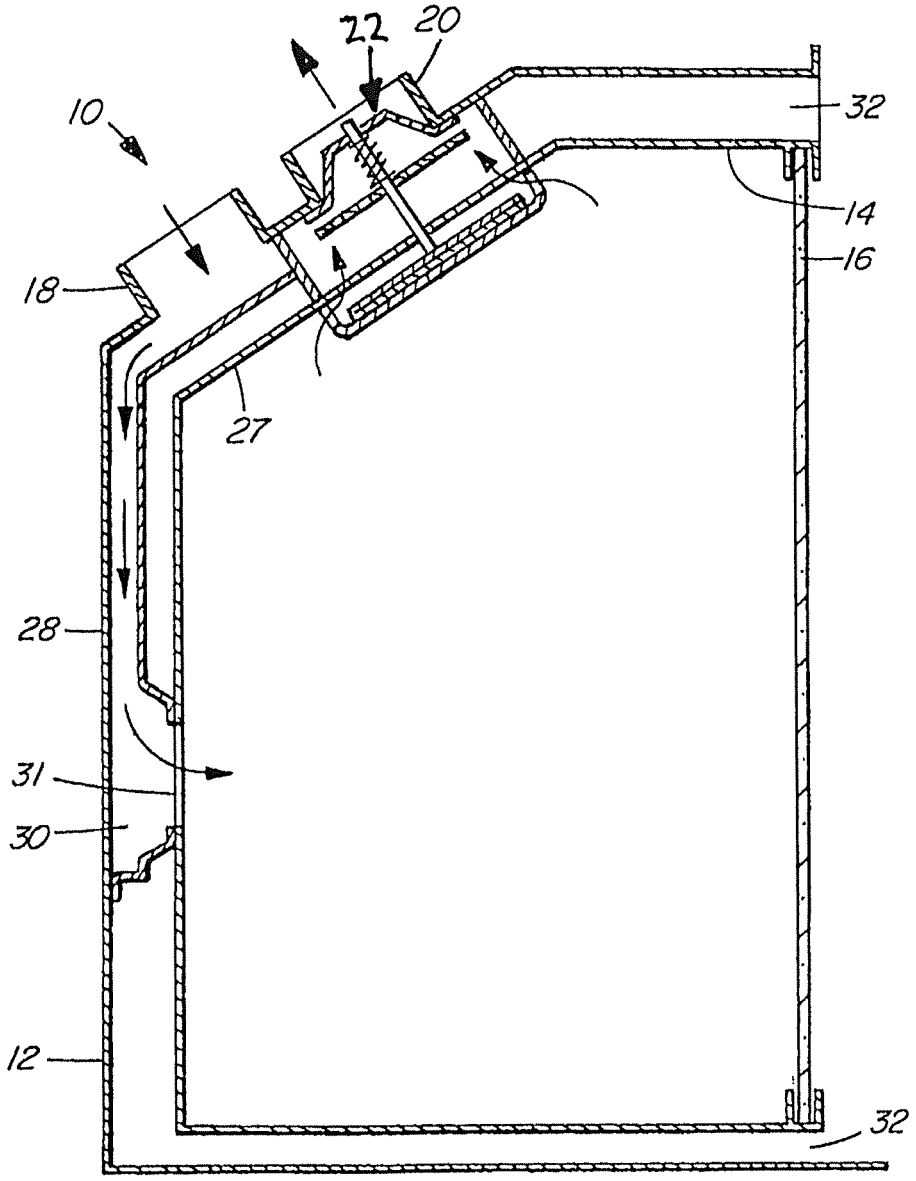
FIG. 10 is a sectional view of an insert for a sealed combustion gas fireplace in accordance with an alternate embodiment of the invention.

The operation of damper mechanism 22 is shown in FIGS. 7 and 8. In the open vent position, as shown in FIG. 7, the bi-metallic strips 36 are flat, allowing spring 40 to extend along shaft 38, biasing the restrictor plate 42 as far as possible away from bracket 46. Bracket 46 is preferably attached to the inside surface of a shroud 12 at an air vent 18, and is preferably of a configuration, such as the narrow elongated shape shown in FIG. 6, that impedes air flow through the vent as little as possible. In the embodiment shown in FIGS. 5, 7, and 8, the damper mechanism 22 is attached to the intake air vent 18, but it will be understood that the damper mechanism 22 may also be positioned in the exhaust vent as shown in FIG. 10.

FIG. 7 shows the damper mechanism 22 in an inactive or open vent position, which is the position of the damper mechanism 22 when the fireplace is cold or not in use. In this situation, it is preferable to have essentially unrestricted air flow, such that sufficient air is available to the fireplace to maintain initial ignition. The restrictor plate 42 is therefore biased by spring 40 away from retainer 34, such that air vent 18 is clear, allowing essentially unobstructed, maximum air flow.

Once the ignition has taken place and the burner is operating normally, a lower level of air flow is required for optimal operation of the fireplace. Bi-metallic strips 36, exposed to the heat generated within the firebox will flex under the heat, eventually reaching an active or closed vent position, best shown in FIG. 8. In this position, strips 36 flex away from each other within retainer 34, and mechanically push shaft 38 up towards air vent 18, compressing spring 40 and moving restrictor plate 42 towards bracket 46. In this position, restrictor plate 42 partially closes air vent 18, impeding the air flow through the vent 18 and allowing for more efficient burning and better heat retention during operation of the fireplace.

As it is not desirable to completely cut off the air flow to the fireplace, apertures 44 may be provided to allow some minimum constant air flow. Alternatively or in addition, the damper mechanism 22 may be adjusted, such as by lengthening the spring 40 or adjusting the position of the restrictor plate 42 on shaft 38, such that the restrictor plate does not contact the bracket 46. This embodiment would also restrict the air flow through the air vent 18 without closing off the vent completely.

The pair of bi-metallic strips 36 may be replaced with a single bi-metallic strip. It may be necessary to make appropriate adjustments, such as changing the length of the shaft 38 or the length of the spring 40 to ensure that the amount of flexion of the strip under typical heating conditions is sufficient to move the restrictor plate as far towards the air vent as necessary. The length of shaft 38 and the position of the restrictor plate 42 on shaft 38 may also be adjusted such that shaft 38 and bi-metallic element 36*a* are not in physical contact until after the bi-metallic element 36*a* has flexed a certain amount. After contact is made, the damper mechanism 22 will operate as described above, until the restrictor element 42 reaches its final position near air vent 18.

In an alternative embodiment, the restrictor element itself be a bi-metallic element, such that it flexes to directly restrict the passageway in which it is installed. Such an arrangement would reduce the need for multiple components in the damper mechanism but may require a lateral positioning of the restrictor along a portion of the passageway.

In the preferred embodiment, the damper mechanism is mounted on a firebox wall such that the bimetallic elements react to the changes in temperature in the firebox. Nonetheless, it is contemplated that the damper mechanism may be arranged in the combustion products exhaust system 58 (either in the exhaust duct 54 or in the vicinity of the exhaust outlet 20) to react to the increase in temperature of the combustion gases in that system as the fireplace enters full burning operation. Accordingly, the damper may be configured to react to changes of temperature in the combustion products exhaust system 58 rather than directly sensing temperature changes in the firebox 14. Alternatively, the damper mechanism 22 may be placed within convection passageway 32, from where it can respond to changes in temperature of the air flowing through convection passageway 32 to and from the room where the fireplace is located, in the same manner as described above.

It will be appreciated by those skilled in the art that the preferred and alternative embodiments have been described in some detail but that certain modifications may be practiced without departing from the principles of the invention.

The invention claimed is:

1. A direct vent gas fireplace having a combustion air supply and exhaust system that is substantially sealed in relation to a room in which said gas fireplace is disposed, said combustion air supply being drawn from a substantially vertical inlet duct and said fireplace being connected to a substantially vertical exhaust duct, said fireplace comprising a single combustion air inlet for drawing combustion air from outside the building in which said fireplace is located into a firebox, further comprising a restrictor element located in and spanning said inlet and a temperature-sensitive element located near said inlet to react to an increase in temperature of a combustion chamber of said fireplace, said restrictor element and said temperature-sensitive element being operative to cause said restrictor element to allow a maximum throughput through said inlet when the fireplace has not been ignited and being operative to partially restrict said inlet in response to an increase in temperature of a temperature-sensitive element.

2. A direct vent gas fireplace having a firebox and a combustion air supply and exhaust system that is substantially sealed in relation to a room in which said gas fireplace is disposed, said combustion air supply being drawn from a substantially vertical inlet duct comprising a single substantially vertical combustion products exhaust duct for venting combustion products from the fireplace to the outside of a building in which said fireplace is located, further comprising a restrictor element located in and spanning said exhaust duct and a temperature-sensitive element located in proximity to said combustion chamber to react to an increase in the temperature of a combustion chamber of said fireplace, said restrictor element and said temperature-sensitive element being operative to cause said restrictor element to allow a maximum throughput through said duct when the fireplace has not been ignited and being operative to partially restrict said duct in response to an increase in temperature of a temperature-sensitive element.

3. A direct vent gas fireplace having a combustion air supply and exhaust system that is substantially sealed in relation to a room in which said gas fireplace is disposed, said combustion air supply being drawn from a substantially vertical inlet duct and said fireplace being connected to a substantially vertical exhaust duct, said fireplace comprising a single combustion air inlet for drawing combustion air from outside the building in which said fireplace is located into a firebox, further comprising a restrictor element located in and spanning said inlet and a temperature-sensitive element located near said inlet to react to an increase in temperature of a combustion chamber of said fireplace, said restrictor element and said temperature-sensitive element being operative to cause said restrictor element to allow a maximum throughput through said inlet when the fireplace has not been ignited and being operative to partially restrict said inlet in response to an increase in temperature of said temperature-sensitive element, said temperature sensitive element comprises a bi-metallic element, wherein said restrictor element is mounted on a shaft, said shaft being displaced axially along the central axis of the air inlet by said deformation of said bi-metallic element, and further comprising a coil spring positioned concentrically around said shaft for biasing said restrictor toward said bimetallic element and wherein said bi-metallic element is mounted in an enclosure on a wall of said firebox by a retainer, said retainer constraining the direction of deformation of said bi-metallic element as it is heated, said coil spring being delimited by the restrictor element and by a bracket spanning the air inlet.

4. The gas fireplace of claim 3 wherein said spring biases said restrictor element toward a position wherein said restrictor element does not restrict said air flow when said firebox is cold.

5. The gas fireplace of claim 3 wherein said restrictor element comprises a plurality of apertures.

6. The gas fireplace of claim 3 further comprising an elongated shaft between said bi-metallic element and said restrictor element, said shaft actuating movement of said restrictor element by abutment against an end of said shaft when said bi-metallic element deforms under the influence of a change in temperature.

7. A method of controlling combustion air flow and facilitating ignition in a direct vent, sealed combustion gas fireplace, said fireplace having a combustion chamber and a single combustion air inlet from the outside of a building in which the fireplace is located into said fireplace said combustion air supply being drawn from a substantially vertical inlet duct and said fireplace being connected to a substantially vertical exhaust duct, comprising the steps of:

operating a bi-metallic element to physically react to an increase in temperature in a combustion chamber of said fireplace;

operating a restrictor element that spans said air inlet to move so as to decrease the throughput of combustion air through said inlet upon deformation of said bi-metallic element in response to an increase in temperature, to thereby automatically restrict the entire throughput of combustion air to said fireplace as the temperature in the combustion chamber increases.

8. The method of claim 7 wherein said bi-metallic element is spring-biased away from said air passageway.

9. The method of claim 7 further comprising the step of igniting a combustion gas source within a firebox in said fireplace to increase the temperature of said fireplace.

* * * * *